US010088177B2

(12) United States Patent
Jeung et al.

(10) Patent No.: US 10,088,177 B2
(45) Date of Patent: Oct. 2, 2018

(54) AIR CONDITIONER AND METHOD FOR CONTROLLING THE SAME

(71) Applicant: LG ELECTRONICS INC., Seoul (KR)

(72) Inventors: Jonghwan Jeung, Seoul (KR); Jaewan Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 193 days.

(21) Appl. No.: 14/710,705

(22) Filed: May 13, 2015

(65) Prior Publication Data

US 2015/0330644 A1 Nov. 19, 2015

(30) Foreign Application Priority Data

May 15, 2014 (KR) ..... 10-2014-0058467

(51) Int. Cl.

| | |
|---|---|
| ***F25D 17/04*** | (2006.01) |
| ***F24F 1/22*** | (2011.01) |
| ***F24F 1/50*** | (2011.01) |
| ***F24F 1/52*** | (2011.01) |
| ***F24F 11/30*** | (2018.01) |
| ***F24F 11/70*** | (2018.01) |
| *F24F 110/00* | (2018.01) |
| *F24F 11/42* | (2018.01) |

(52) U.S. Cl.

CPC ..... *F24F 1/22* (2013.01); *F24F 1/50* (2013.01); *F24F 1/52* (2013.01); *F24F 11/30* (2018.01); *F24F 11/70* (2018.01); *F24F 11/42* (2018.01); *F24F 2110/00* (2018.01); *F24F 2221/52* (2013.01)

(58) Field of Classification Search

CPC .. F24F 1/22; F24F 1/52; F24F 11/0076; F24F 1/06; F24F 1/58; F24F 11/001; F24F 2221/52; F25D 29/00

See application file for complete search history.

(56) References Cited

U.S. PATENT DOCUMENTS

| | | | | |
|---|---|---|---|---|
| 3,801,779 A | | 4/1974 | Ver Sluis | |
| 5,345,223 A | * | 9/1994 | Rutkiewicz ..... | G08B 19/02 340/309.16 |

(Continued)

FOREIGN PATENT DOCUMENTS

| | | |
|---|---|---|
| CN | 1825012 | 8/2006 |
| CN | 101561167 | 10/2009 |

(Continued)

OTHER PUBLICATIONS

Korean Office Action dated Oct. 7, 2016 issued in Application No. 10-2014-0058467.

(Continued)

*Primary Examiner* — Len Tran
*Assistant Examiner* — Kamran Tavakoldavani
(74) *Attorney, Agent, or Firm* — KED & Associates LLP

(57) ABSTRACT

An air conditioner may have a structure in which a snowfall detection device is attached to a grill and a case, and an amount of snow accumulated on the grill is detected in a non-contact manner to control an operation of the air conditioner. The snowfall may be more stably and reliably detected, and also the air conditioner may more stably and reliably operated.

10 Claims, 7 Drawing Sheets

(56) References Cited

U.S. PATENT DOCUMENTS

| | | | | |
|---|---|---|---|---|
| 2010/0081371 | A1* | 4/2010 | Dinicolas | F24F 1/58 454/275 |
| 2012/0047931 | A1* | 3/2012 | Mangum | F25B 49/027 62/186 |
| 2012/0265785 | A1* | 10/2012 | Paik | G11B 19/08 707/771 |
| 2015/0114014 | A1* | 4/2015 | Choi | F24F 1/06 62/89 |

FOREIGN PATENT DOCUMENTS

| | | | | |
|---|---|---|---|---|
| CN | 101726050 | | 6/2010 | |
| CN | 201652701 | | 11/2010 | |
| CN | 104566639 | | 4/2015 | |
| EP | 2180264 | A2 * | 4/2010 | F24F 1/06 |
| EP | 2 865 953 | A1 | 4/2015 | |
| JP | H 05-323044 | B2 | 12/1993 | |
| JP | H08-334271 | | 12/1996 | |
| JP | 2003232557 | | 8/2003 | |
| JP | 2012-092529 | | 5/2012 | |
| KR | 10-2004-0007973 | | 1/2004 | |
| KR | 10-2007-0083055 | | 8/2007 | |
| KR | 2010-0048548 | | 5/2010 | |
| KR | 10-20130090515 | A | 8/2013 | |
| KR | 10-2013-0101362 | | 9/2013 | |

OTHER PUBLICATIONS

European Search Report dated Oct. 7, 2015 issued in Application No. 15166025.5.

Korean Office Action for Application 10-2014-0058467 dated Apr. 26, 2016 (full Korean text).

Chinese Office Action dated Aug. 2, 2017 issued in Application No. 201510239199.8 (English translation attached).

* cited by examiner

AIR CONDITIONER AND METHOD FOR CONTROLLING THE SAME

CROSS-REFERENCE TO RELATED APPLICATION

The present application claims priority under 35 U.S.C. 119 and 35 U.S.C. 365 to Korean Patent Application No. 10-2014-0058467, filed in Korea on May 15, 2014, the subject matter of which is hereby incorporated by reference.

BACKGROUND

1. Field

Embodiments may relate to an air conditioner and a method for controlling an air conditioner.

2. Background

Air conditioners are cooling/heating systems in which indoor air is suctioned to heat-exchange the suctioned air with a low or high-temperature refrigerant, and then the heat-exchanged air is discharged into an indoor space to cool or heat the indoor space, wherein the above-described operations are repeatedly performed. Air conditioners may generate a series of cycles using a compressor, a condenser, an expansion valve, and an evaporator.

Air conditioners may be largely classified as integration type air conditioners or separation type air conditioners. In an integration type air conditioner, a compressor, a condenser, an expansion valve, and an evaporator for a refrigeration cycle are disposed in one case. In a separation type air conditioner, an indoor heat exchanger is disposed in an indoor unit, and an outdoor heat exchanger and a compressor are disposed in an outdoor unit. The two devices separated from each other may be connected to each other by using a refrigerant tube.

The integration type air conditioner may be classified as a window type air conditioner that is hung and directly installed on a window, and a duct type air conditioner that is installed in an outdoor space by connecting a suction duct to a discharge duct. The separation type air conditioner may be classified as a wall-mount type air conditioner in which an indoor unit is perpendicularly installed, and a ceiling type air conditioner that is installed on a ceiling.

FIG. 1 is a view of an air conditioner.

FIG. 1 shows a multi-type air conditioner 1 in which at least one outdoor unit 2 and a plurality of indoor units 3 are serially connected to each other.

An outdoor heat exchanger, an outdoor unit fan 6, and a compressor are disposed in a case 4 that defines an outer appearance of the outdoor unit 2. The case has an opened top surface to discharge air to the outside when the outdoor unit fan 6 operates. A grill 5 is disposed on the top surface of the case to prevent foreign substances from being introduced into the case 4.

Since the outdoor unit 2 is installed in an outdoor space, the outdoor unit 2 may have an influence on weather and an outdoor temperature. More particularly, when it snows in a state where the outdoor unit 2 does not operate, snow may be accumulated on the outdoor unit 2 and then frozen to block an air discharge passage or deteriorate air discharge efficiency. As a result, the air conditioner 1 may deteriorate in efficiency.

To solve the above-described limitation, an air conditioner including a snowfall detection part for detecting an amount of snow accumulated on an outdoor unit is disclosed in Korean Patent Publication No. 10-2013-0090515, the subject matter of which is incorporated herein by reference.

However, the snowfall detection part may directly contact snow to detect an amount of snowfall. Thus, if snow is not accumulated on the snowfall detection part, then the snowfall detection part may not operate normally. Additionally, since the snowfall detection part is exposed to the outside, the snowfall detection part may be damaged or have a difficulty in stable installation and fixation.

BRIEF DESCRIPTION OF THE DRAWINGS

Arrangements and embodiments may be described in detail with reference to the following drawings in which like reference numerals refer to like elements, and wherein.

DETAILED DESCRIPTION

Reference may now be made in detail to embodiments of the present disclosure, examples of which are illustrated in the accompanying drawings. The technical scope of the embodiments may fall within the scope of this disclosure, and addition, deletion, and modification of components or parts are possible within the scope of the embodiments.

Figure 1:
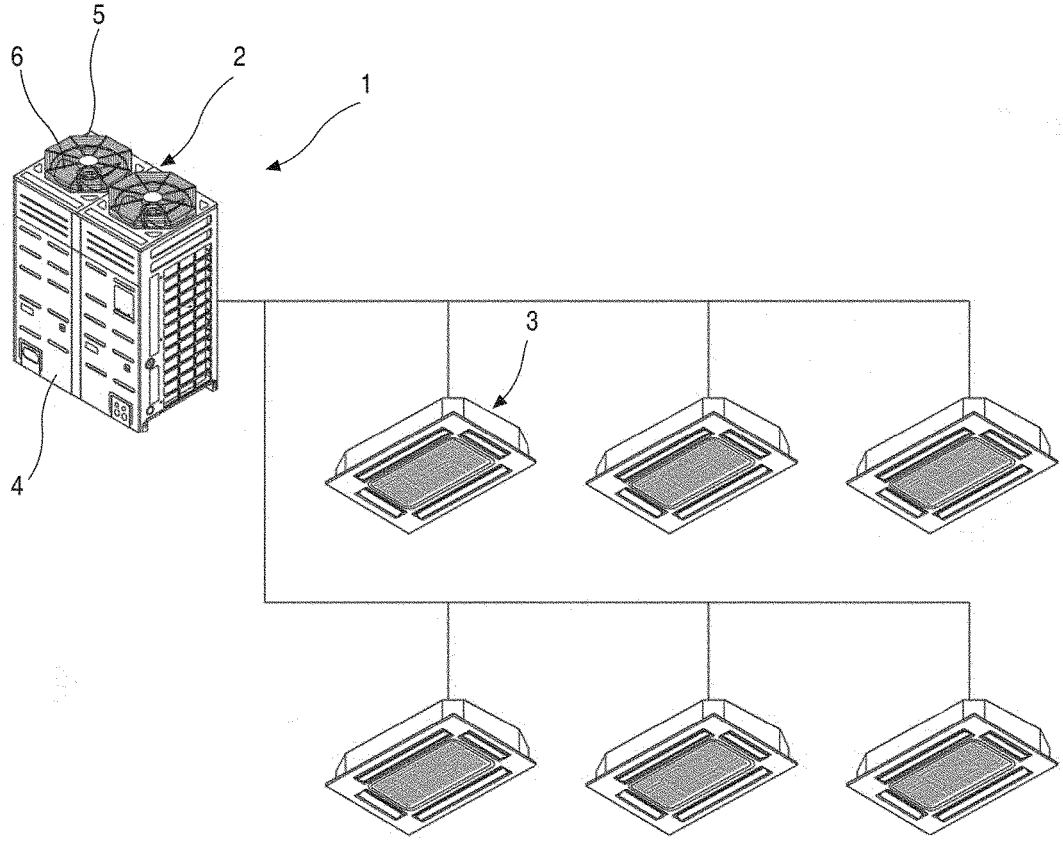
FIG. 1 is a view of a general air conditioner.
Figure 2:
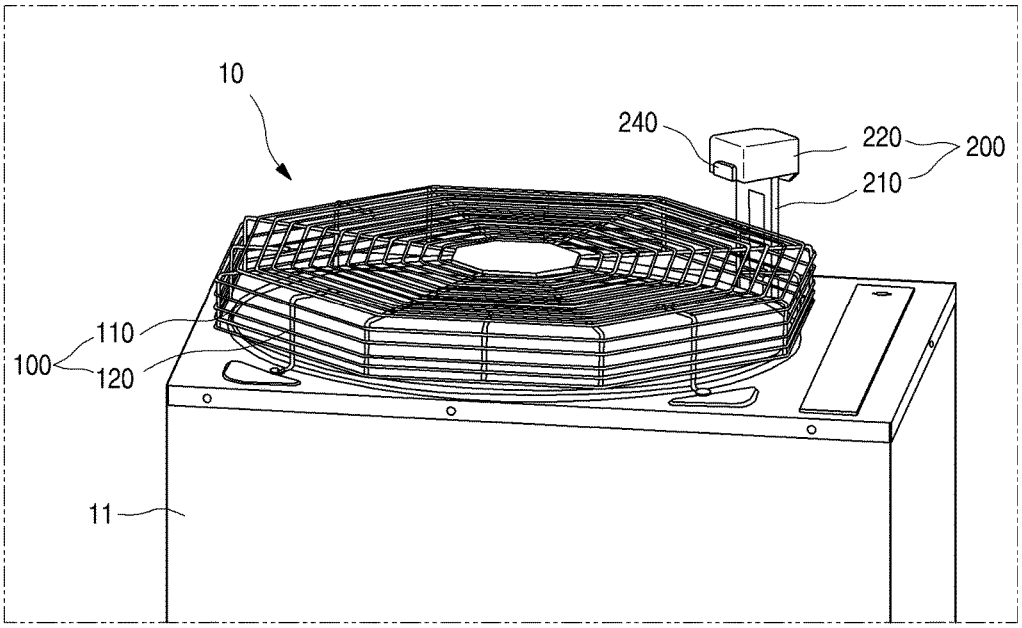
FIG. 2 is a view illustrating an upper portion of an outdoor unit of an air conditioner according to an example embodiment.
Figure 3:
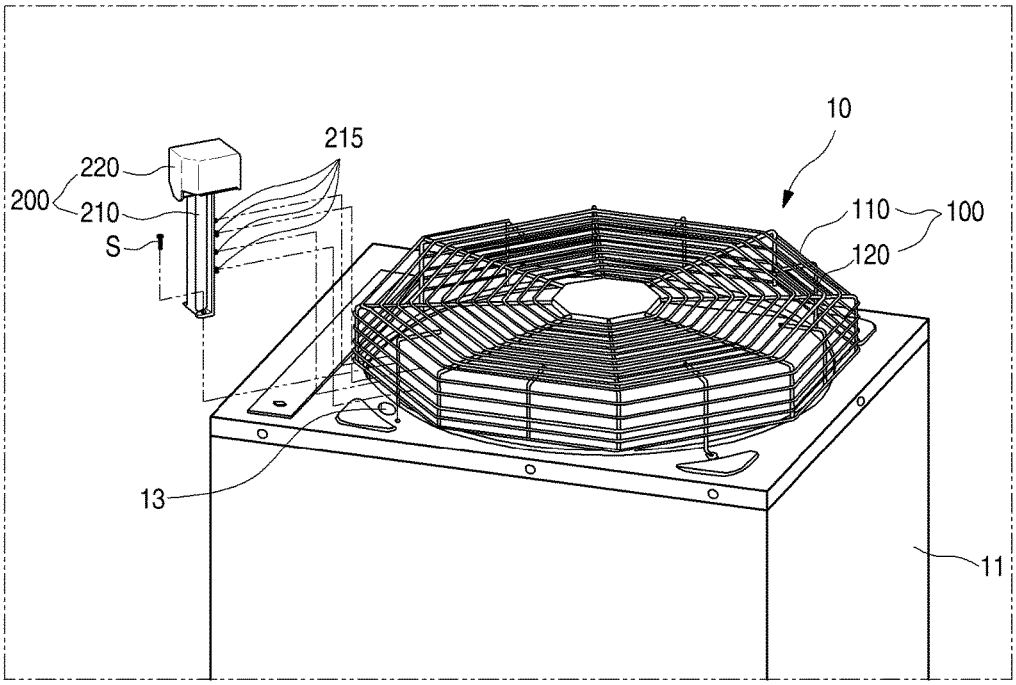
FIG. 3 is an exploded perspective view illustrating a coupling structure of a snowfall detection device that is a main part of the air conditioner.

FIG. 2 is a view illustrating an upper portion of an outdoor unit of an air conditioner according to an example embodiment. FIG. 3 is an exploded perspective view illustrating a coupling structure of a snowfall detection device that is a main part of the air conditioner. Other embodiments and configurations may also be provided.

Referring to FIGS. 2 and 3, an air conditioner according to an example embodiment includes an indoor unit and an outdoor unit 10 that are connected to each other by using a refrigerant tube. The outdoor unit 10 has an outer appearance that is defined by a case 11. A compressor, an outdoor heat exchanger, an outdoor unit fan, and a fan motor 12 for rotating the outdoor unit fan are disposed in the case 11.

A discharge hole for discharging air is at a top surface of the case 11, and the outdoor unit fan is disposed directly under the discharge hole. Thus, when the fan motor 12 operates, the outdoor unit fan may rotate to discharge air heat-exchanged with the outdoor heat exchanger through the discharge hole.

A grill 100 is disposed on the discharge hole. The grill 100 may have a structure formed by a plurality of wires to prevent foreign substances from being introduced into the discharge hole. The grill 100 may be disposed on an upper region of the discharge hole and have a predetermined height on a top surface of the case 11.

The grill 100 may include a plurality of horizontal parts 110, each of which has a circular or polygonal shape, arranged to be spaced at a predetermined distance from each other and a plurality of vertical parts 120 connecting the plurality of horizontal parts 110 to each other and extending to cross the horizontal parts 110.

The horizontal parts 110 may be disposed at a predetermined distance upward from the top surface of the case 11. The horizontal parts 110 may be disposed at a predetermined distance so that the upper horizontal parts 110 have a plurality of inner diameters that gradually decrease at the same height.

The vertical parts 120 have lower ends that are fixed to the top surface of the case 11 and extend upward to connect the plurality of horizontal parts 110 to each other and then are bent toward a center of the horizontal parts 110. The vertical parts 120 are disposed at a predetermined distance along circumferences of the horizontal parts 110.

A snowfall detection device 200 for detecting an amount of snow accumulated on the grill 100 is disposed on one side of the grill 100. The snowfall detection device 200 is mounted outside the grill 100. The snowfall detection device 200 may have a lower end that is fixed to the case 11, and extends upward to be fixed to the grill 100. The snowfall detection device 200 may further extend upward from the grill 100 to detect, in a non-contact manner, an amount of snow accumulated on the grill at an upper side of the grill 100.

Figure 4:
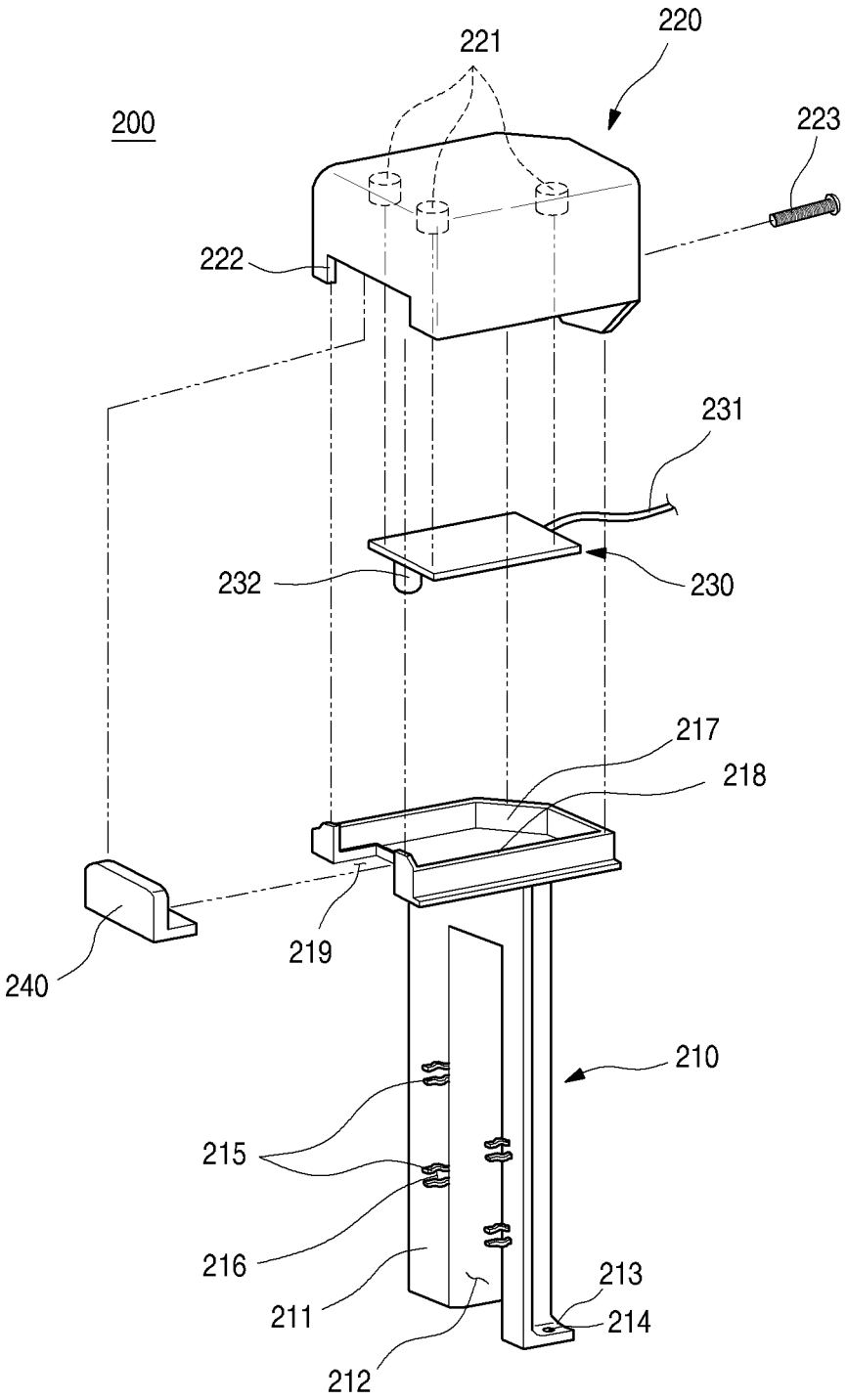
FIG. 4 is an exploded perspective view of the snowfall detection device.
Figure 5:
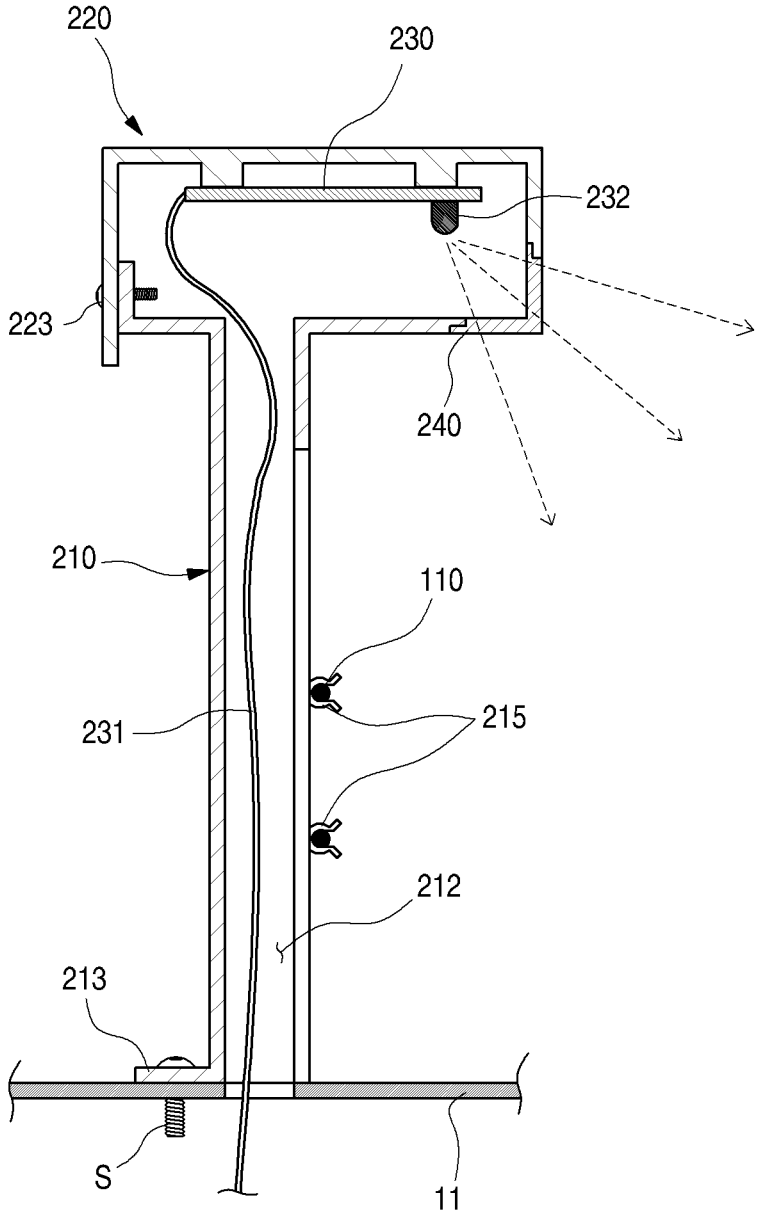
FIG. 5 is a cross-sectional view of the snowfall detection device.
Figure 6:
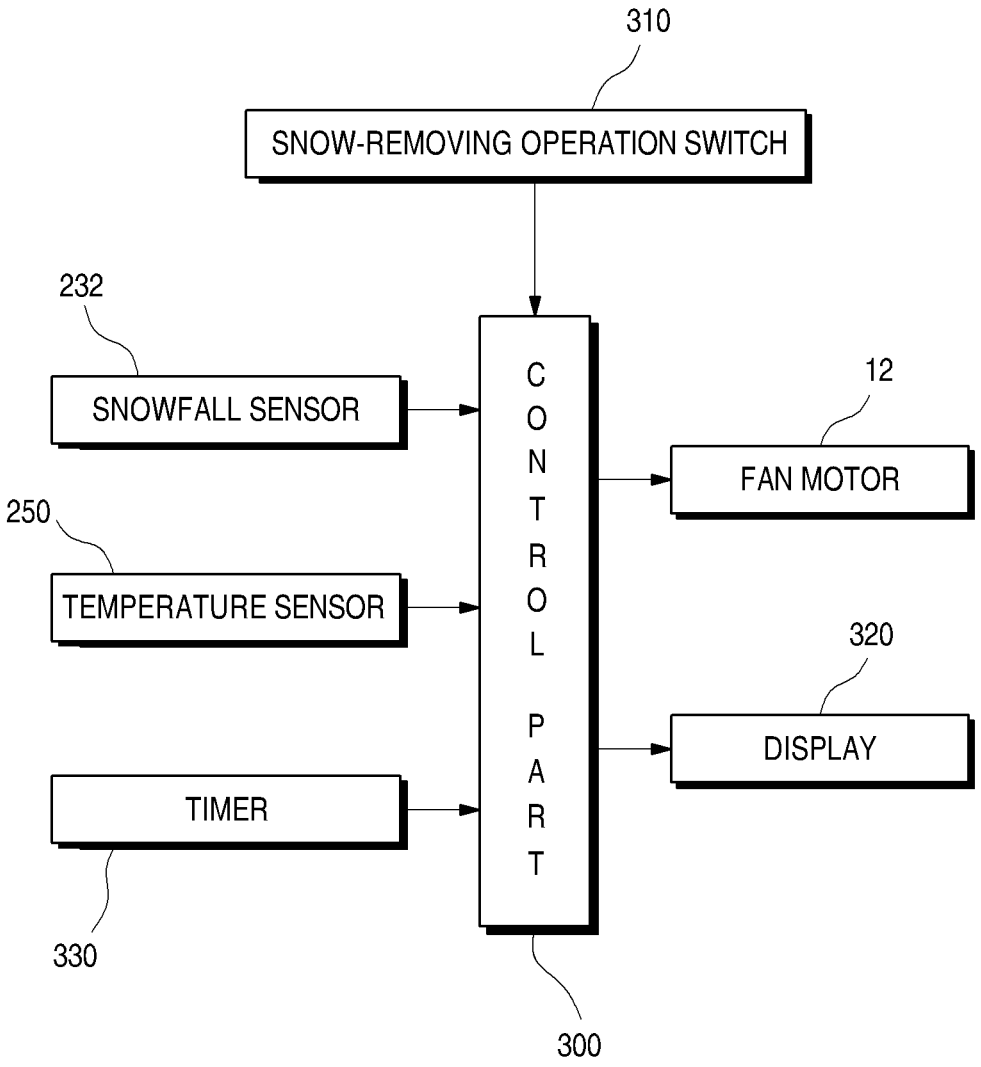
FIG. 6 is a schematic block diagram illustrating control parts of the outdoor unit.

FIG. 4 is an exploded perspective view of the snowfall detection device. FIG. 5 is a cross-sectional view of the snowfall detection device. FIG. 6 is a schematic block diagram illustrating control parts of the outdoor unit. Other embodiments and configurations may also be provided.

Referring to FIGS. 4 to 6, the snowfall detection device 200 may include a detection device body 210 that is fixed to the grill 100 so that a snowfall sensor 232 is disposed above the grill 100 and a detection device cover 220 coupled to the detection device body 210 to accommodate a printed circuit board (PCB) 230 on which the snowfall sensor 232 is mounted.

The detection device body 210 may include an extension part 211 having a predetermined length to vertically extend and an accommodation part 217 disposed on an upper end of the extension part 211 to provide a space for accommodating the PCB 230.

The extension part 211 may vertically extend to a height that is greater than a height of the grill 100. That is, the extension part 211 may extend to a height that is enough to measure an amount of snow accumulated on the grill 100. A wire guide part 212, through which an electric wire 231 connecting the PCB 230 to a control part 300 passes, is disposed in the extension part 211. The wire guide part 212 may lengthily extend downward from an upper side and be recessed to accommodate the electric wire 231.

The wire guide part 212 may be opened toward the grill 100. A lower end of the wire guide part 212 is disposed at a position corresponding to a wire hole 13 defined in the top surface of the case 11 to guide the electric wire 231 passing through the wire guide part 212 toward the inside of the case 11.

A separate cover for covering the wire guide part 212 or an accommodation member having a tube shape for accommodating the electric wire 231 may be further provided on the wire guide part 212 to prevent the electric wire 231 from being exposed to the outside.

A main body coupling part 213 is disposed on a lower end of the extension part 211. The main body coupling part 213 may fix the extension part 211 to the top surface of the case 11. A screw hole 214, through which a screw S passes, may be defined in the main body coupling part 213, and the main body coupling part 213 may contact the top surface of the case 11. Thus, when the screw S is coupled at an upper portion of the main body coupling part 213, the screw S may pass through the main body coupling part 213 and the top surface of the case 11 to fix the lower end of the extension part 211 to the top surface of the case 11.

A fixing part 215 coupled to one side of the grill 100 may be further disposed on one side of the extension part 211. A portion of the grill 100 may be press-fitted into the fixed part 215 to allow the extension part 211 to be fixed to the grill 100. The fixing part 215 may have a groove 216 having a shape corresponding to a cross-section of the grill 100.

The fixing part 215 may be provided in plurality. The plurality of fixing parts 215 may be disposed to be vertically spaced apart from each other. The horizontal parts of the grill 100 may be press-fitted into grooves of the fixing parts 215, respectively. The extension part 211 may be fixed to the grill 100 in a state where the extension part 211 is hung on the grill 100. The extension part 211 may be stably fixed on the grill 100 by the plurality of fixing parts 215.

The snowfall detection device 200 may be fixed to the top surface of the case 11 by the main body coupling part 213, and simultaneously, the mounted state of the snowfall detection device 200 fixed to the grill 100 may be maintained by the fixing parts 215.

The accommodation part 217 is disposed on an upper end of the extension part 211 to define a surface that extends in a horizontal direction crossing the extension part 211. The accommodation part 217 has an edge along a bottom surface thereof to define a predetermined space. The accommodation part 217 has an opened top surface.

A wire through-hole 218 is defined in the bottom surface of the accommodation part 217. The wire through-hole 218 may communicate with the wire guide part 212 defined in the extension part 211. The electric wire 231 of the PCB 230 may pass through the wire through-hole 218 and then be guided to the inside of the case 11 along the wire guide part 212.

An opening 219 is defined in the accommodation part 217. The opening 219 may be configured for sensing of the snowfall sensor 232 disposed inside the accommodation part 217. For example, the opening 219 may be used as a passage for transmitting or receiving light such as infrared light or laser beams and ultrasonic waves according to a kind (or type) of sensor.

A separate transmission window 240 may be disposed on the accommodation part 217. The transmission window 240 may have a shape corresponding to the accommodation part 217. The transmission window 240 may be formed of a light transmission material or have a light transmission structure.

A detection device cover 220 may be disposed above the accommodation part 217. The detection device cover 220 may be coupled to the accommodation part 217. The detection device cover 220 may have a cross-section with a shape corresponding to the accommodation part 217 to provide a space for accommodating the PCB 230 when the detection device cover 220 is coupled to the accommodation part 217.

The detection device cover 220 may have an opened bottom surface, and the PCB 230 may be disposed inside the detection device cover 220. A PCB mounting part 221, on which the PCB 230 is mounted, is disposed on an inner surface of the detection device cover 220 to attach the PCB 230 thereto.

The PCB 230 may be disposed in an upper portion of the space defined when the detection device cover 220 and the accommodation part 217 are coupled to each other in the state where the PCB 230 is attached to the detection device cover 220 to prevent the PCB 230 from being wetted by stagnant water generated due to dew condensation.

The snowfall sensor 232 for detecting a snowfall amount may be mounted on the PCB 230. The PCB 230 may be connected to the control part mounted on the outdoor unit 10 through the electric wire 231. The snowfall sensor 232 may be disposed at a position at which the snowfall sensor 232 irradiates infrared light or ultrasonic waves onto the grill 100 through the opening 219.

A hook part 222 that is hooked with a front end of the accommodation part 217 is disposed on the detection device cover 220. A coupling member 223, such as a screw, is coupled to one side of the detection device cover 220, which faces the hook part 222 to maintain the coupled state of the detection device cover 220 with the accommodation part 217.

A temperature sensor 250 for measuring external temperature may be further disposed on one side of the outdoor unit 10. The temperature sensor 250 may be disposed on one side of the outdoor unit 10, which is capable of measuring the external temperature. The temperature sensor 250 may be disposed on the snowfall detection device 200.

The temperature sensor 250 may be connected to the control part 300 to determine whether the external temperature (or outdoor temperature) corresponds to a temperature at which snow is capable of being accumulated. The snowfall sensor 232 may be activated according to the external temperature determined by the temperature sensor 250, and the control unit 300 may determine an operation according to a detected value of the snowfall sensor 232.

The control part 300 may further include a humidity sensor or an air pressure sensor. Thus, an environment in which snowfall is possible may be confirmed first by using the auxiliary detection device (such as the humidity sensor or air pressure sensor) and then detect and determine a snowfall amount by using the snowfall sensor 232.

A distance sensor that irradiates infrared light to measure an angle of the reflected light, thereby calculating a distance between a surface of accumulated snow and the snowfall sensor 232 and determining a snowfall amount may be used as the snowfall sensor 232 for detecting an amount of snow accumulated on the grill 100.

A motion sensor, such as a PRI sensor for detecting movement, may be used as the snowfall sensor 232 to detect a predetermined amount of snow accumulated between the grill 1000 and the snowfall sensor 232, thereby determining the snowfall.

A non-contact temperature sensor may be used as the snowfall sensor 232. The noncontact temperature sensor may detect a variation in temperature on the surface of the grill 100 (on which snow is accumulated) by using a thermal infrared image or infrared light to determine the snowfall when the detected temperature is less than a preset temperature.

An operation of the air conditioner having the above-described structure may be described in more detail with reference to the accompanying drawings.

Figure 7:
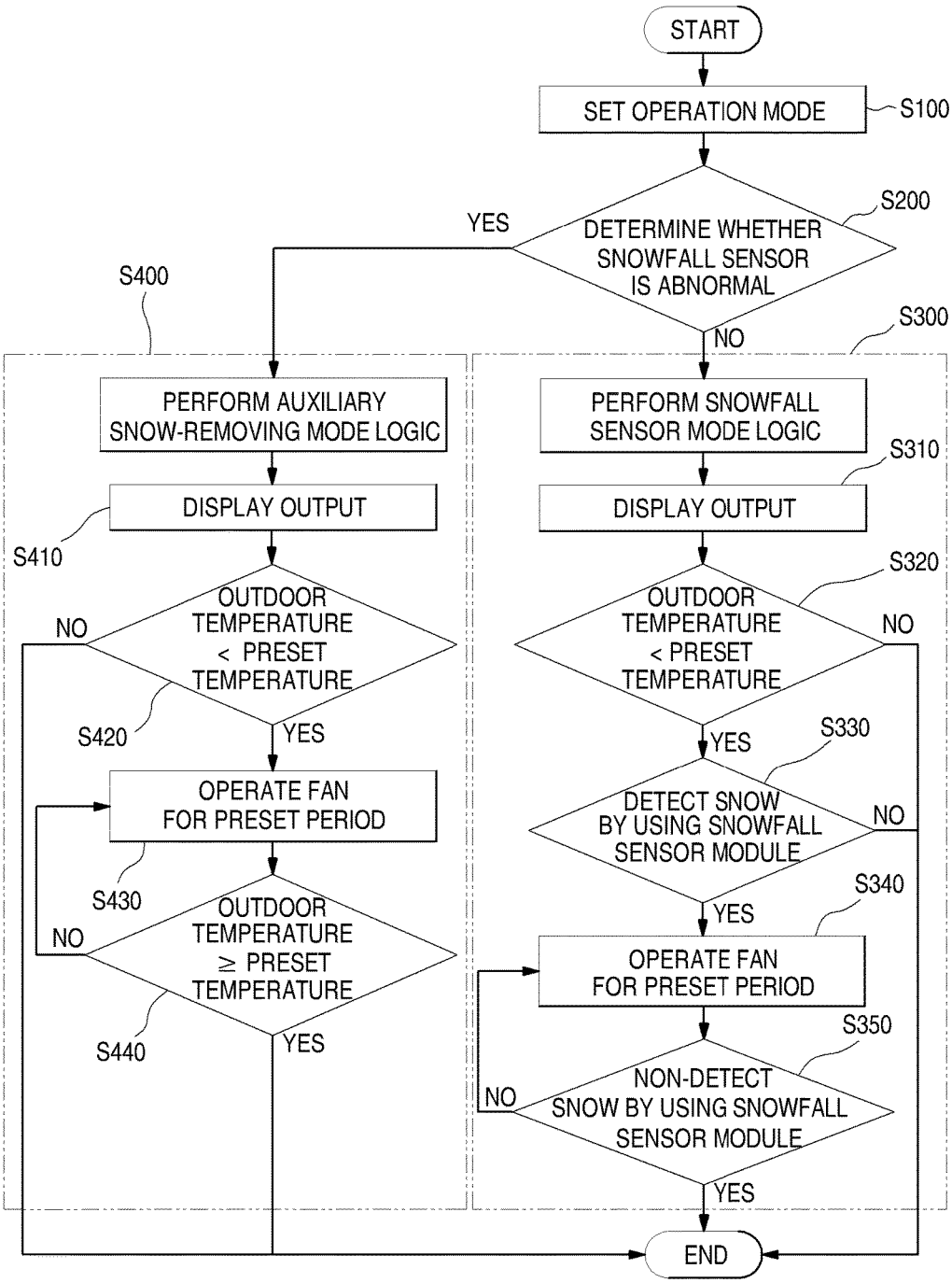
FIG. 7 is a flowchart of a method for controlling the air conditioner.

FIG. 7 is a flowchart of a method for controlling the air conditioner. Other operations and embodiments may also be used.

The air conditioner may operate by user's manipulation or preset program according to status of the indoor space to cool or heat the indoor space. If it is unnecessary to cool or heat the indoor space, the air conditioner may not operate or may be turned off or in a standby state. When the cooling or heating is required, the air conditioner may operate again.

Snow may be accumulated on the outdoor unit 10 in winter. If a preset amount (or more) of snow is accumulated on the grill 100, a snow-removing operation for driving the fan motor 12 may be performed to remove the snow when accumulation of the snow is detected by the snowfall sensor 232.

The snow-removing operation may be described with reference to FIG. 7.

First, when the user determines that the snow-removing operation is necessary, the user may manipulate and set a switch 310 for performing the snow-removing operation. In other seasons except for the winter in which the snow-removing operation is necessary, the switch 310 may be turned off to fundamentally block an activation of the snow-removing mode (S100).

In the state where the switch 310 is set in the snow-removing mode, it may be determined whether the snowfall sensor 232 is normal. The snowfall sensor 232 may output a voltage of 0 V when the snowfall sensor 232 is disconnected and output a voltage of about 5 V or more when the snowfall sensor 232 is short-circuited, based on an output voltage of the sensor. The control part 300 may determine that the snowfall sensor 232 is normal when a voltage value outputted from the snowfall sensor 232 is within a preset value (about 0 V to about 5 V) or a preset range. On the other hand, the control part 300 may determine that the snowfall sensor 232 is abnormal when a voltage value outputted from the snowfall sensor 232 is out of the preset value (S200) or the preset range.

If the snowfall sensor 232 is normal, snowfall sensor mode logic using the snowfall sensor 232 may be performed (S300). For this, an operation state of the snowfall sensor mode may be displayed on a display 320 to allow the user to identify the snowfall sensor mode (S310).

The temperature sensor 250 may determine whether an outdoor temperature is lower than a preset temperature. The preset temperature may be a temperature at which snowfall is possible, such as snowfall possible temperature. When the outdoor temperature is above the preset temperature, since the condition in which the snowfall is impossible is satisfied, the snow-removing operation is ended (S320).

When the outdoor temperature is below the preset temperature, since the snowfall is possible, a detection value of the snowfall sensor 232 is confirmed. Of course, to more accurately confirm possibility of the snowfall, additional sensors such as an air pressure sensor and humidity sensor in addition to the temperature sensor 250 may be further provided. Whether the snowfall is possible may be determined by synthetically combining the conditions by using the sensors.

The snowfall sensor 232 may determine whether snow is accumulated on the grill 100, or a preset amount (or more) of snow is accumulated on the grill 100 under the snowfall possible condition. The snowfall sensor 232 may transmit and receive light or sound waves for detecting snow into/from the grill 100 from an upper side of the grill 100 in the non-contact manner to determine accumulation of snow or an amount of snow.

When it is determined that the snow is not accumulated on the grill 100, or an amount of snow accumulated on the grill 100 is less than the preset amount by the snowfall sensor 232, since the snow does not have an influence on an operation of the air conditioner, then the snow-removing operation is ended (S330).

When it is determined that the snow is accumulated on the grill 100, or an amount of snow accumulated on the grill 100 is greater than the preset amount by the snowfall sensor 232, then the outdoor unit fan may operate for a preset time to blow the snow accumulated on the grill 100, thereby removing the snow accumulated on the grill 100 (S340).

When the outdoor unit fan rotates for the preset time, and then a preset time (for example, about 15 minutes) through a timer 330 elapses, then the snowfall may be detected by using the snowfall sensor 232. When the snowfall is detected, then the fan motor 12 may operate again to rotate the outdoor fan. If not, then the snowfall operation is ended (S350).

If the snowfall sensor 232 is abnormal, then the operation using the snowfall sensor mode logic may be impossible. In this state, the snowfall sensor 232 may operate according to auxiliary snow-removing mode logic (S400).

For the operation in the auxiliary snow-removing mode, the operation in the auxiliary snow-removing mode may be displayed on the display 320 to allow the user to recognize that the snowfall sensor is abnormal (S410).

The temperature sensor 250 may determine whether an outdoor temperature is lower than a preset temperature. The preset temperature may be a temperature at which snowfall is possible. When the outdoor temperature is above the preset temperature, since the condition in which the snowfall is possible is satisfied, then the snow-removing operation is ended (S420).

When the outdoor temperature is less than the preset temperature, a preset time (for example, about 30 minutes) through the timer 330 may elapse regardless of confirmation of the snowfall amount to drive the fan motor. The outdoor unit fan may rotate to blow the snow accumulated on the grill 100, thereby removing the snow accumulated on the grill 100. The preset time in the auxiliary snow-removing mode may be longer than the preset time in the snowfall sensor mode to remove the snow for a relatively longer time (S430).

As described above, rotation of the outdoor fan may be repeatedly performed every preset time. When the outdoor temperature ascends to a temperature that is above the preset temperature, since the snowfall is impossible, then the snowfall operation is ended (S440).

According to embodiments, the snowfall detection device may detect, in the non-contact manner, an amount of snow accumulated from an upper side of the grill. Thus, when compared to the direct contact manner, an amount of snowfall may be accurately detected, and the snowfall may be effectively detected without direct contact to improve operation reliability.

The embedded sensor of the snowfall detection device may be accommodated in the detection device body defining the outer appearance of the snowfall detection device. Thus, the detection device body may be stably fixed to the outdoor unit to prevent the snowfall detection device or the embedded sensor from being damaged and be maintained in the stable installation state at a position at which the snowfall is easily detected.

The abnormal state of the snowfall detection device may be grasped to perform an operation of the snowfall detection device for preventing snow from being accumulated. In the abnormal state, the outdoor unit fan may operate to perform the efficient response operation with respect to the snowfall under any circumstances.

Embodiments may provide an air conditioner in which a snowfall detection device is fixed to a grill and a case to detect, in a non-contact manner, an amount of snow accumulated on the grill, thereby to control an operation of the air conditioner, so that snowfall is more stably and reliably detected, and the air conditioner more stably and reliably operates, and a method for controlling the same.

Embodiments may also provide an air conditioner having a structure for stably fixing a snowfall detection device to a grill and a case.

Embodiments may also provide a method for controlling an air conditioner that performs a stable response operation even though a snowfall detection device is abnormal to improve operation reliability.

In at least one embodiment, an air conditioner includes: a case defining an outer appearance of an outdoor unit, the case accommodating an outdoor heat exchanger, an outdoor unit fan, and a fan motor for operating the outdoor unit fan therein; a grill preventing foreign substances from being introduced through a discharge hole that is opened in the case; a snowfall detection device extending upward from one side of the grill to detect an amount of snow accumulated on the grill from an upper side of the grill in a non-contact manner; and a control part operating the fan motor according to a snowfall detection signal inputted from the snowfall detection device to rotate the outdoor unit fan, thereby removing snow accumulated on the grill and the outdoor fan.

The snowfall detection device may include a distance sensor that measures a distance between a surface of the snow accumulated on the grill and the snowfall detection device to detect an amount of snow.

The snowfall detection device may include a motion sensor that detects movement of the snow falling between the grill and the snowfall detection device and an amount of snow.

The snowfall detection device may include a temperature sensor that measures a variation in temperature on a surface of the grill in the non-contact manner to detect the snowfall and an amount of snow.

The snowfall detection device may include: a detection device body fixed and mounted on a top surface of the case to extend upward from the grill; a PCB disposed on an upper end of the detection device body and on which a snowfall sensor for detecting the snowfall and an amount of snow is mounted; and a detection device cover coupled to the upper end of the detection device body to provide an accommodating space for accommodating the PCB therein.

The PCB may be mounted on an inner top surface of the detection device cover.

The snowfall detection device may be fixed and mounted on a top surface of the case, and a wire hole through which an electric wire connected to the control part passes may be defined in the top surface of the case, which corresponds to a lower end of the snowfall detection device.

The snowfall detection device may further include a wire guide part that is recessed to accommodate the electric wire to extend toward the wire hole.

A plurality of fixing parts that are press-fitted into the grill and fixed and mounted on the grill may be disposed on one side of the snowfall detection device.

In at least another embodiment, a method for controlling an air conditioner may include: detecting an outdoor temperature; detecting snowfall or an amount of snow accumulated on a grill by using a snowfall detection device disposed above the grill when the outdoor temperature is less than a snowfall possible temperature; and controlling an operation of a fan motor for rotating an outdoor unit fan for a preset period through a control part to remove the snow accumulated on the grill when the snowfall or a predetermined amount of snow is detected.

The method may further include setting a turn on/off of a snow-removing operation by user's switch manipulation before the outdoor temperature is detected.

The method may further include a voltage outputted from the snowfall sensor before the outdoor temperature is detected, wherein, when the output voltage is within a preset voltage range, it may be determined that the snowfall sensor is normal to operate in a snowfall sensor mode by detection of the snowfall of the snowfall sensor, and when the output voltage is out of the preset voltage range, it may be determined that the snowfall sensor is abnormal to operate in an auxiliary snow-removing mode in which the fan motor operates for the preset period.

After the state of the snowfall sensor is determined, the state or operation mode of the snowfall sensor may be displayed on a display.

In at least another embodiment, a method for controlling an air conditioner may include: comparing an output voltage of a snowfall detection device for detecting an amount of snow accumulated on a grill to perform a snowfall removing operation, wherein, when the output voltage is within a preset voltage range, a fan motor for rotating an outdoor unit fan operates for a first preset period according to the detection of the snowfall detection device to remove the snow accumulated on the grill, and when the output voltage is out of the preset voltage range, the fan motor operate for a second preset period to rotate the outdoor unit fan.

The snowfall removing operation may be performed when an outdoor temperature is less than a preset temperature at which the snowfall is possible.

The second preset period may be set to be longer than the first set period.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioner comprising:

a case to provide an outer appearance of an outdoor unit, the case to accommodate an outdoor heat exchanger, an outdoor unit fan, and a fan motor for operating the outdoor unit fan therein;

a grill to prevent foreign substances from being introduced through a discharge hole into the case, the grill including:

a plurality of horizontal parts arranged to be spaced apart from each other in a vertical direction, and a plurality of vertical parts to extend to cross the horizontal parts and connect the plurality of horizontal parts to each other;

a snowfall detection device to detect, in a non-contact manner, snow accumulated on the grill; and a control part to operate the fan motor and rotate the outdoor unit fan based on a snowfall detection signal from the snowfall detection device, wherein the snowfall detection device includes:

an extension part extending vertically from the case, the extension part having a coupling part coupled to a top surface of the case;

a fixing part provided at a surface of the extension part, and the fixing part coupled to a lateral side of one of the plurality of horizontal parts;

a groove depressed from the surface of the extension part, and an electric wire to be inserted into the groove;

an accommodation plate disposed on an upper portion of the extension part to provide an installation space;

a circuit board accommodated in the installation space, the circuit board connecting with the electric wire; and a snowfall sensor provided on the circuit board to detect the snowfall; and a detection device cover coupled to a detection device body to shield the installation space, the circuit board being mounted on an inner surface of the detection device cover, wherein:

the fixing part includes first and second fixing parts disposed at both sides of the groove, and wherein one of the plurality of horizontal parts of the grill extends from the first fixing part towards the second fixing part.

2. The air conditioner according to claim 1, wherein the control part controls the outdoor unit fan such that outdoor unit fan removes snow from the grill and the outdoor fan.

3. The air conditioner according to claim 1, wherein the snowfall sensor includes a distance sensor to measure a distance between a surface of the snow on the grill and the snowfall detection device.

4. The air conditioner according to claim 1, wherein the snowfall sensor includes a motion sensor to detect movement of the snow between the grill and the snowfall detection device.

5. The air conditioner according to claim 1, wherein the snowfall detection device includes a temperature sensor to measure temperature on a surface of the grill in the non-contact manner.

6. The air conditioner according to claim 1, wherein the snowfall detection device is attached to a surface of the case, and the case includes a wire hole at the surface of the case, the wire hole to receive the electric wire connected to the control part.

7. The air conditioner according to claim 1, wherein the fixing part includes:

a third fixing part spaced apart from the first fixing part in a vertical direction; and a fourth fixing part spaced apart from the second fixing part in a vertical direction.

8. The air conditioner according to claim 7, wherein:

the first and second fixing parts are coupled to a first horizontal part of the plurality of horizontal parts; and the third and fourth fixing parts are coupled to a second horizontal part of the plurality of horizontal parts.

9. The air conditioner according to claim 7, wherein at least one of the first fixing part, the second fixing part, the third fixing part and the fourth fixing part includes a groove to receive the one of the plurality of horizontal parts.

10. The air conditioner according to claim 1, further comprising a through hole formed at the accommodation plate, and wherein the electric wire extends towards the groove from the circuit board, passing through the through hole.

* * * * *